US006132684A

United States Patent [19]

Marino

[11] Patent Number: 6,132,684

[45] Date of Patent: Oct. 17, 2000

[54] SAMPLE TUBE HOLDER

[75] Inventor: Kenneth J. Marino, Owings Mills, Md.

[73] Assignee: Becton Dickinson and Company, Franklin Lakes, N.J.

[21] Appl. No.: 08/961,668

[22] Filed: Oct. 31, 1997

[51] Int. Cl.[7] ..... B01L 9/00

[52] U.S. Cl. ..... 422/104; 422/99; 422/102; 422/103; 211/74

[58] Field of Search ..... 422/99, 102, 103, 422/104; 211/74; 220/680, 681, 682

[56] References Cited

U.S. PATENT DOCUMENTS

| | | | |
|---|---|---|---|
| 2,979,210 | 4/1961 | Patterson | 211/74 |
| 3,184,071 | 5/1965 | Delaire | 211/74 |
| 3,474,913 | 10/1969 | Jungner et al. | 211/74 |
| 3,604,566 | 9/1971 | Rem | 211/74 |
| 3,847,200 | 11/1974 | Kopp et al. | 159/16.1 |
| 4,124,122 | 11/1978 | Emmitt | 211/74 |
| 4,364,904 | 12/1982 | Eberle | 422/104 |
| 4,407,958 | 10/1983 | DeGraff, Jr. | 435/287 |
| 4,495,150 | 1/1985 | Cook et al. | 422/99 |
| 4,787,523 | 11/1988 | Kalous | 211/74 |
| 5,133,939 | 7/1992 | Mahe | 422/104 |
| 5,282,543 | 2/1994 | Picozza et al. | 220/255 |
| 5,632,388 | 5/1997 | Morrison et al. | 211/74 |
| 5,651,941 | 7/1997 | Stark et al. | 422/104 |
| 5,670,120 | 9/1997 | Degenhardt et al. | 422/104 |

FOREIGN PATENT DOCUMENTS

| | | |
|---|---|---|
| 0369840 | 5/1990 | European Pat. Off. . |
| 0488769 | 6/1992 | European Pat. Off. . |
| 0642828 | 3/1995 | European Pat. Off. . |
| 0711603 | 5/1996 | European Pat. Off. . |
| 8804938 | 7/1988 | Germany . |
| 4440294 | 5/1996 | Germany . |
| 8228756 | of 1996 | Japan . |

*Primary Examiner*—Harold Y. Pyon
*Attorney, Agent, or Firm*—David W. Highet, Esq.

[57] ABSTRACT

A tube holder for resilient plastic test tubes, and corresponding method for using the same, comprising a plurality of plates, each of which has openings that are substantially aligned with the openings in the other plates. One of the plates is moveable in a lateral direction with respect to the other plates so that when the tubes are inserted in the openings and the plate is moved in the lateral direction, the walls of the moveable plate forming the openings exert force against their corresponding tubes to press the tubes against the walls of the other plates that form the openings in those plates to thus secure the tubes in the openings. The moveable plate can be also be released from applying the force against the tubes to allow the tubes to move essentially freely in the openings. Because the bottoms of the tubes are unobstructed, the tubes can be inserted directly into openings of another device corresponding to the openings in the plates.

10 Claims, 12 Drawing Sheets

SAMPLE TUBE HOLDER

BACKGROUND OF THE INVENTION

1. Field of the Invention

The present invention relates to a sample tube holder into which a plurality of sample tubes can be inserted, and a corresponding method for using the same.

2. Description of the Related Art

Many different types of racks or holders exist which are suitable for storing and transporting a plurality of containers, such as test tubes or the like, which hold a biological sample. However, many of these racks or holders are not configured to allow the test tubes or containers (hereinafter "test tubes" or "tubes") to be inserted directly into other devices which have a plurality of openings for accommodating the plurality of test tubes.

An example of such a device is a heating block having a plurality of cylindrical openings, each of which is configured to receive a single test tube. The heating block is thus able to heat the entire circumference of each test tube that is inserted into one of the openings and thus, effectively radiates and conducts heat to the samples present in the test tubes. This type of heating block is particularly useful as a lysing heating block that is employed in a DNA amplification process in which the cells in the samples stored in the tubes are heated to a temperature which causes them to rupture and release their DNA into the surrounding fluid in the test tube.

Most conventional test tube holders or racks (hereinafter "test tube holders") are incapable of inserting the test tubes into the corresponding holes of the heating block while the test tubes remain in the test tube holder, because these types of test tube holders typically have a base portion on which the bottoms of the test tubes rest when the test tubes are inserted in the holes into the test tube holder. These types of test tube holders are designed in this manner so that the base portion prevents the test tubes from sliding downward out of the openings in the test tube holder when the test tube holder is lifted. In other words, the openings in the test tube holder which accommodate the test tubes are usually large enough to allow the test tubes to freely slide in and out, and do not provide any force against the test tubes to prevent them from sliding out of the openings if the base of the test tube holder was not present.

Other types of test tube holders exist, such as that described in U.S. Pat. No. 2,979,210 to Patterson, in which slideable plates having corresponding openings are used to adjust the overall size of the openings in the rack to accommodate test tubes having different diameters. However, although the sliding plates can set the openings to essentially conform to the diameters of the tubes so that the tubes will stand upright in their respective openings with little or no play, this tube holder still requires a base portion for supporting the bottoms of the tubes because the tubes are capable of sliding out of the openings.

Another test tube holder is described in U.S. Pat. No. 5,133,939 to Mahe. The Mahe test tube holder includes a flexible member, having a plurality of holes, that is sandwiched between two plates having a plurality of holes which correspond with the holes in the flexible member. The diameters of the holes in the flexible member are slightly smaller than the diameters of the holes in the plates. Thus, when test tubes having diameters that essentially correspond to the diameters of the holes in the plates are inserted into the holes, the flexible member provides a frictional force about the test tubes and thus essentially restricts the test tubes from moving longitudinally in the openings. Because the test tubes are retained in the openings by the force applied to them by the flexible member, this type of test tube rack can be used with a dry bath incubator, for example, having a plurality of tube accommodating openings, to insert the test tubes directly into the openings of the dry bath incubator without removing the test tubes from the rack.

Nevertheless, this type of rack requiring a flexible member is somewhat ineffective because after many uses, the flexible member can become worn due to the frictional force exerted by the test tubes when being inserted into and removed from the openings. Furthermore, the properties of the flexible member can be adversely affected by the heat being applied to the test tubes and the rack by the incubator.

In addition, the flexible member allows the test tubes to shift and become slanted in their respective openings, thus making it difficult to align the tubes with the holes in the incubator. Also, the force applied to the test tubes by the flexible member is generally insufficient to secure the test tubes firmly enough in the openings so that an operator can unscrew the caps from the test tubes without grasping the body of the test tube to prevent the test tube from spinning. Furthermore, these types of multi-layered test tube holders can be complicated and expensive to manufacture.

Accordingly, a continuing need exists for an improved test tube holder that is capable of securely maintaining the test tubes in the openings of the holder without the use of a flexible material or a base which supports the bottoms of the test tubes.

SUMMARY OF THE INVENTION

An object of the present invention is to provide an improved test tube holder that is capable of securely holding a plurality of tubes or containers in a plurality of corresponding openings without obstructing the bottoms of the tubes so that the plurality of tubes can be inserted directly into corresponding openings in another device, such as a heating block or the like, without being removed from the holder.

A further object of the invention is to a provide test tube holder having a plurality of openings for housing a plurality of tubes, and which is capable of securing the tubes in the openings without the use of a flexible member that exerts frictional force on the tubes to maintain the tubes in the openings.

A further object of the invention is to provide a test tube holder having a plurality of openings for accommodating a plurality of tubes, and having an engaging member which engages the plurality of tubes in the openings to maintain the tubes at fixed positions in the openings during an engaged mode, and which releases the tubes in a released mode so as to allow them to freely slide in the openings.

These and other objects of the present invention are substantially achieved by providing an apparatus having a plurality of plates, each of which has openings that are substantially aligned with each other. One of the plates is moveable in a lateral direction with respect to the other plates so that when the tubes are inserted in the openings and the plate is moved in the lateral direction, the walls of the moveable plate forming the openings exert force against their corresponding tubes to press the tubes against the walls in the other plates that form the openings in those plates to thus secure the tubes in the openings. The moveable plate can be released from applying the force against the tubes to allow the tubes to move essentially freely in the openings.

The present invention further provides a method for holding a plurality of test tubes using the exemplary apparatus disclosed and claimed herein.

BRIEF DESCRIPTION OF THE DRAWINGS

These and other objects and advantages of the present invention will be more readily appreciated from the following detailed description taken in conjunction with the accompanying drawings, in which.

DETAILED DESCRIPTION OF THE PREFERRED EMBODIMENTS

Figure 1:
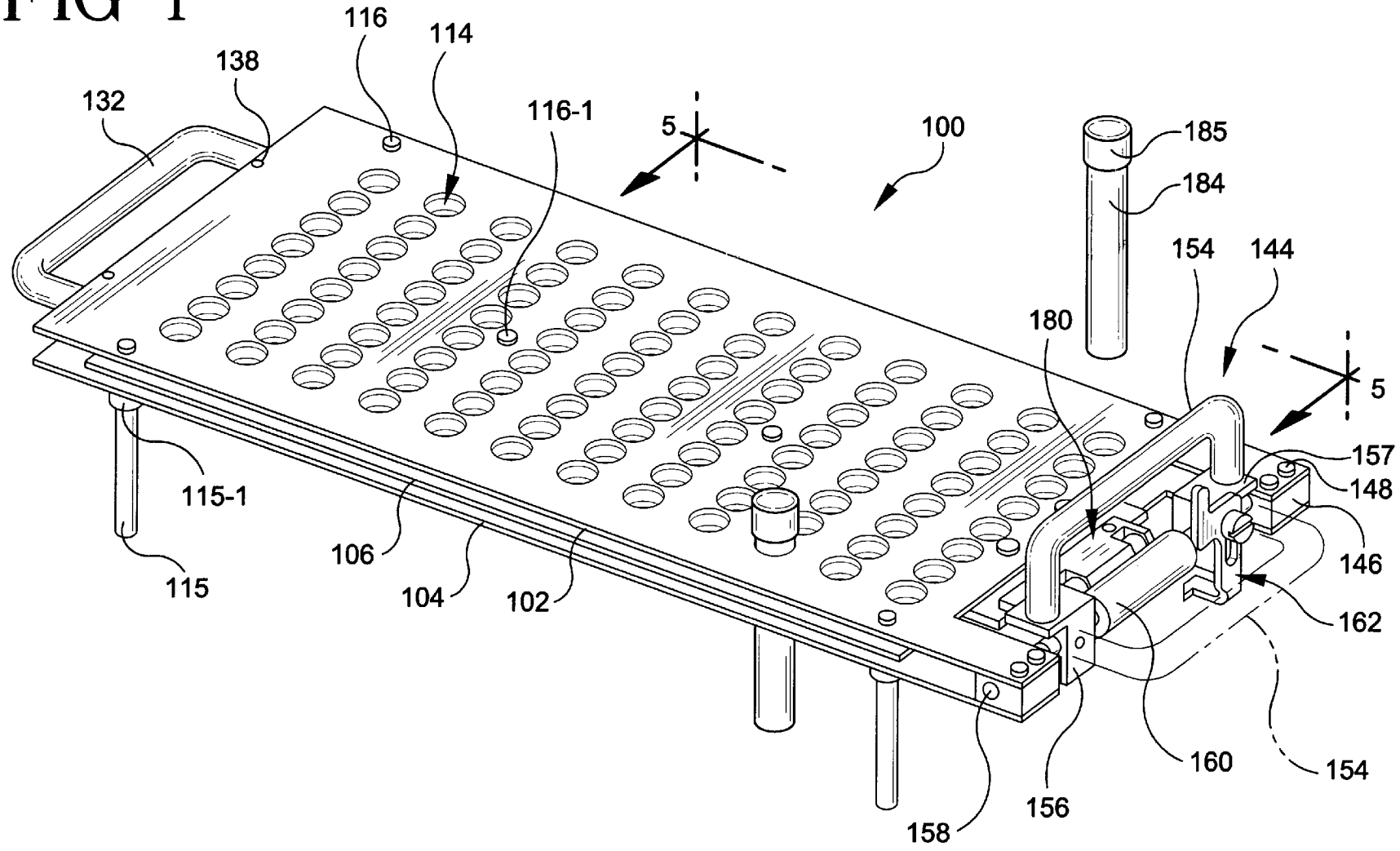
FIG. 1 is a perspective view of a test tube in accordance with a preferred embodiment of the present invention, illustrating insertion of tubes into the openings of the test tube holder.

FIG. 1 is a perspective view illustrating an example of a test tube holder 100 for holding a plurality of containers or, in particular, plastic test tubes or sample tubes, according to an embodiment of the present invention. As shown in more detail in FIG. 2, test tube holder 100 includes an upper plate 102, a lower plate 104 and a middle plate 106. The upper plate 102, lower plate 104, and middle plate 106 can be made of metal such as aluminum, stainless steel or any other suitable material. Preferably, the middle plate 106 has a thickness greater than the thickness of each of the upper and lower plates 102 and 104. For instance, the thickness of middle plate 106 can be twice the thickness of the upper plate 102 and bottom plate 104. For reasons explained below, the middle plate 106 is shorter than the upper and lower plates 102 and 104.

As further illustrated, upper plate 102 has a plurality of tube openings 108 disposed therein which are formed by walls 109. In this embodiment, the tube openings 108 are arranged in 12 rows of 8 openings each, or, in other words, the upper plate 102 has a 12×8 array tube openings 108.

In a similar manner, lower plate 104 includes a plurality of aligned tube openings 110 formed by walls 111. The tube openings 110 are arranged in a manner identical or essentially identical to that in which the tube openings 108 are arranged in the upper plate 102. Hence, the lower plate 104 has an array of 12×8 tube openings 110 which are aligned with the openings 108. It is noted that the number of tube openings 108 and 110 in the upper and lower plates 102 and 104, respectively, can be any number, as long as upper plate 102 and lower plate 104 have an equal amount of tube openings. Also, each of the tube openings 108 and 110 are the same or substantially the same diameter. Although the tube openings 108 and 110 are shown as being round, the tube openings 108 and 110 can have any shape suitable to accommodate the tube or container that is to be inserted therein.

Figure 2:
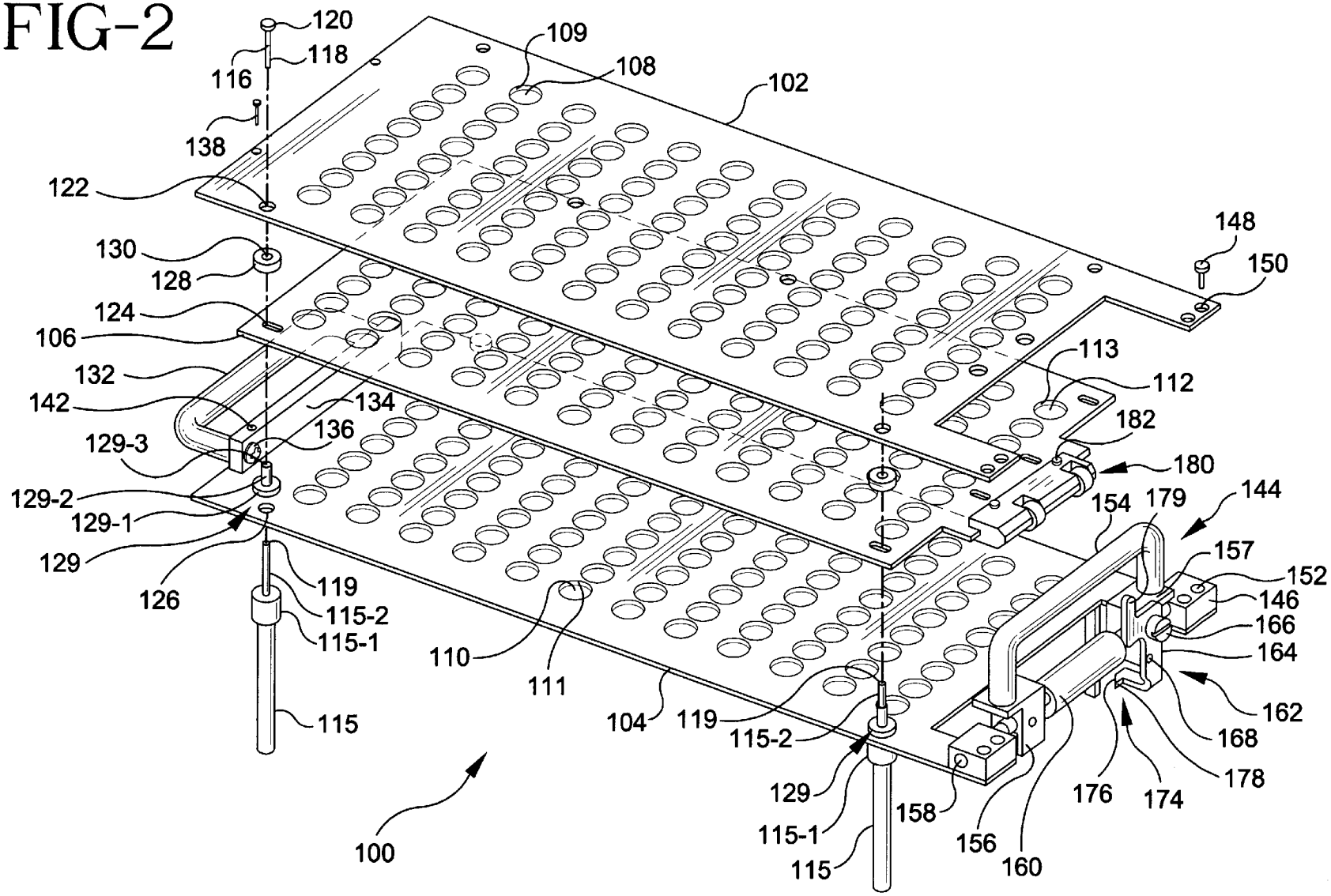
FIG. 2 is an exploded perspective view of the test tube holder shown in FIG. 1.

As further shown in FIG. 2, middle plate 106 includes a plurality of tube openings 112 formed by walls 113. The number of tube openings 112 in middle plate 106 is equal to the number of tube openings 108 and 110 in upper and lower plates 102 and 104, respectively. Hence, in this embodiment, the middle plate 106 includes a 12×8 array of tube openings 112, which are aligned with tube openings 108 and 110. However, for reasons discussed below, the tube openings 112 in the middle plate 106 are slightly larger than the tube openings 108 and 110 in upper and lower plates 102 and 104, respectively. In particular, in this embodiment, the tube openings 112 are slightly oval shaped with a somewhat larger diameter in the lengthwise direction of the middle plate 106 than in the transverse direction of the middle plate 106. For instance, the diameter in the lengthwise direction can be about 0.570 inch when the diameter in the transverse direction is about 0.520 inch.

The tube openings 108, 110 and 112 in the upper, lower and middle plates 102, 104 and 106, respectively, collectively form a plurality of tube accommodating holes 114. Hence, in this embodiment, the test tube holder 100 includes 96 (i.e., 12×8) tube accommodating holes 114.

As further illustrated, the test tube holder 100 includes a plurality of legs 115. In this embodiment, the tube holder 100 includes four legs 115, each of which is positioned proximate of a corner of the test tube holder 100 as shown. However, the test tube holder 100 can have any number of legs 115 as deemed necessary. The legs 115 enable the test tube holder 110 to rest on a surface (not shown) such that the lower plate 104 is at a distance from the surface equal to or approximately equal to the length of the legs 115. The legs 115 can have any length as deemed appropriate, which is generally determined in accordance with the length of the test tubes with which the test tube holder 100 is to be used.

As further illustrated, the upper plate 102, middle plate 106 and bottom plate 104 are mechanically coupled together by a plurality of pins 116 which mate with the plurality of legs 115. These pins 116 can be threaded pins, rivets, or any suitable pin-type fastener made of any suitable material such as metal, steel or the like, that is capable of securing the plates 102, 104 and 106 together.

Specifically, the pins 116 have a shaft portion 118 and a head portion 120 having a diameter larger than the shaft portion 118. The shaft portion 118 of each pin 116 is inserted through a corresponding hole 122 in the upper plate 102. The middle plate 106 includes holes 124 which correspond to the holes 122, and the lower plate 104 includes holes 126 which correspond to holes 122 and 124. For reasons discussed below, holes 124 in middle plate 106 are slotted openings having a length in the lengthwise direction of middle plate 106 longer than in the transverse direction of middle plate 106, to allow middle plate 106 to move laterally with respect to upper and lower plates 102 and 104.

Washers or spacers 128, which can be made of any suitable material such as Derlin plastic, rubber, metal, or the like, are positioned to space the upper plate 102 from the middle plate 106 when the plates 102, 104, and 106 are coupled together. The spacers 128 include openings 130. Furthermore, plate supporting members 129, which can be made of any suitable material such as Derlin plastic, rubber, metal or the like, are positioned to space the lower plate 104 from the middle plate 106 when the plates 102, 104 and 106 are coupled together. The plate supporting member 129 includes a wide diameter portion 129-1, a narrow diameter portion 129-2, and an opening 129-3 that passes longitudinally through the wide and narrow diameter portions 129-1 and 129-2.

As shown, the legs 115 each include a wider diameter portion 115-1 and a narrow diameter portion 115-2, which includes the opening 119. To couple the plates 102, 104 and 106 together, the narrow portion 115-2 passes through opening 126 in lower plate 104 and opening 129-3 in plate supporting member 129. The narrow portion 129-2 of plate supporting member 129 and the narrow portion 115-2 of the leg 115 (which is inside the opening 129-3 in plate supporting member 129) pass through the opening 130 in washer 128. The top of the narrow portion 115-2 then passes about halfway into opening 122 in the upper plate 102.

As indicated, the shafts 118 of the pins 116 positioned proximate of the four corners of the tube holder 100 pass through their respective openings 122 in plate 102 and are received into opening 119 of a corresponding leg 115. Those four pins 116 are thus secured to the corresponding four legs 115. The diameters of the wide diameter portions 115-1 of legs 115 are larger than the diameters of the openings 126 in the lower plate 104. Also, the diameters of the head portions 120 of the pins 116 are larger than the diameters of the corresponding holes 122 in upper plate 102 through which the shafts 118 of the pins 116 are inserted. Hence, as illustrated, the head portion 120 of those four pins 116 prevent or substantially prevent the plate 102 from moving in a direction away from middle plate 106 and lower plate 104. Likewise, the wide diameter portions 115-1 of legs 115 prevent the lower plate 104 from moving away from middle plate 106 and upper plate 102. As shown, additional pins 116-1 can be inserted through corresponding openings 122, 124 and 126 in plates 102, 106 and 104, respectively, to hold the plates together more securely.

As further shown in FIGS. 1 and 2, the test tube holder 100 includes a stationary handle 132 that is mounted to a handle block 134 by fastening members 136 such as screws, rivets, pins, or the like, which pass through corresponding openings (not shown) in the handle block 134 and into corresponding openings (also not shown) in the stationary handle 132. As illustrated, the block 134 is mounted between upper plate 102 and lower plate 104 by fastening members 138 such as pins, rivets, screws, or the like, which pass through corresponding block mounting openings 140 in the upper plate 102, and are secured into corresponding openings 142 in the block 134. In a similar manner, fastening members 138 are inserted through corresponding openings (not shown) in the bottom plate 104 and into corresponding openings in the bottom of block 134 to secure block 134 to the bottom plate 104. It is noted that the middle plate 106 is not secured to the block 134, and because the middle plate 106 is shorter than upper plate 102 and lower plate 104, it does not contact block 134.

As further illustrated, the test tube holder 100 further includes an actuating handle mechanism 144 that is mounted between upper plate 102 and lower plate 104. Specifically, actuating handle mechanism 144 includes two blocks 146 that are mounted to the upper plate 102 and lower plate 104 by fastening members 148 such as screws, pins, rivets, or the like. As indicated, the fastening members 148 have shafts which pass through corresponding openings 150 in upper plate 102 and engage with corresponding openings 152 in the blocks 146 to secure the blocks 146 to the upper plate 102. In a similar manner, the shafts of other fastening members 148 pass through corresponding openings (not shown) in the lower plate 104 and into corresponding openings (not shown) in the blocks 146 to secure the blocks 146 to the lower plate 104.

It is noted that the openings 150 in the upper plate 102, as well as the corresponding openings (not shown) in the lower plate 104, are slotted. This allows the positions of the blocks 146 to be adjusted as necessary along the lengthwise direction of plates 102 and 104 to adjust the position of the cam 160 (described below) with respect to the cam engaging member 180 (described below) coupled to middle plate 106 to achieve optimum engagement between the cam 160 and cam engaging member 180 and thus compensate for any misalignment due to machining tolerances. The optimum positions of the blocks 146 can be determined by inserting sample tubes into several of the tube accommodating holes 114, and then operating the actuating handle mechanism 114 to determine what position of the blocks 146 along openings 150 provides the best engagement between the cam 160 and cam engaging member 180, and the best engagement of the middle plate 106 with the tubes (as will be described below).

As further illustrated and as will be described in more detail below, the actuating handle assembly 144 further includes an actuating handle 154, handle mounting blocks 156 and 157, a cam shaft 158, a cam 160, and a locking device 162. As will be described in more detail below, the actuating handle 154, handle mounting blocks 156 and 157, cam shaft 158 and cam 160 pivot in unison when the actuating handle 154 is moved from the upright released position as shown by a solid line in FIGS. 1 and 2, to a horizontal or substantially horizontal tube-engaging position as shown in phantom line in FIG. 1.

Although the actuating handle assembly 144 is shown with the actuating handle 154 being a handle of the test tube holder 100, the actuating handle assembly can be configured such that the actuating handle 154 is separate and distinct from the handles by which the test tube holder 100 is carried.

The locking device 162 includes a latch 164 that is pivotally coupled to the handle mounting block 157 by a pin member 166 such as a pin, screw, rivet, or the like. It is noted that the block 157 includes a torsion spring mechanism which engages with the pin member 166 and thus urges the latch 164 in a rest position. Alternatively, instead of a torsion spring being in block 157, the latch 164 can include an opening 168 into which one end of a spring 170 (FIGS. 6 and 11) is attached. The other end of spring 170 can be attached to a pin member 172 (FIGS. 6 and 11) that is mechanically coupled to the other handle mounting block 156. The latch 164 further includes a projection 174 having a slanted surface 176 and a flat surface 178 which function to engage the middle plate 106 in the manner described below to lock the actuating handle 154 in the engaged position. As will also be described in more detail below, the cam 160 engages with a cam engaging member 180, which is secured to middle plate 106 by fastening members 182 such as pins, rivets, screws, or the like, that engage with openings (not shown) in the plate 106.

When all the components of the tube holder 100 are assembled together in the manner described above, the tube holder 100 is configured as shown in FIG. 1. As indicated, containers or tubes 184 can be inserted into a corresponding tube accommodating hole 114 (i.e., made up of corresponding tube openings 108, 110 and 128 as described above) so that the tube 184 passes through the upper plate 102, middle plate 106, and lower plate 104 as indicated. As will be described in more detail below, the tubes 184 can be freely inserted into their respective tube accommodating holes 114 when the actuating handle assembly 144 is positioned in the disengaged upright position as shown by solid line in FIGS. 1 and 2.

As further shown in FIG. 1 specifically, the tubes 184 can be loaded into their corresponding tube accommodating holes 114 when the legs 115 of the test tube holder 100 are resting on, for example, a surface such as a laboratory table top or the like. In this event, the tubes 184 pass through the tube accommodating holes 114 until their bottoms also rest on the surface. As will be described in more detail below, the actuating handle 154 can be moved into the horizontal engaging position so that the middle plate 106 firmly secures the tubes 184 in their corresponding tube accommodating holes 114 so that the test tube holder 100 can be moved to another location without the tubes 184 moving in their corresponding tube accommodating holes 114.

Figure 3:
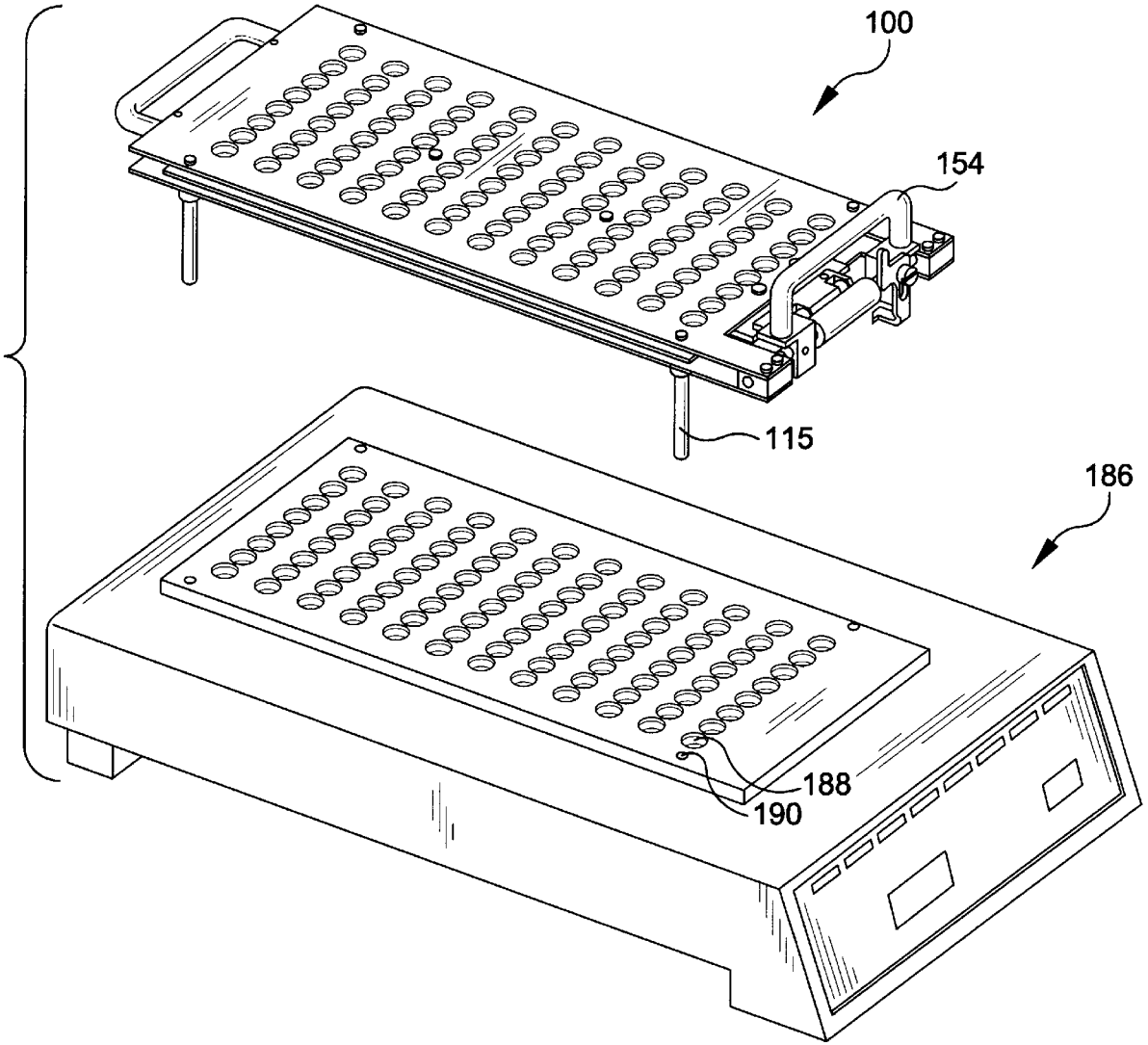
FIG. 3 is a perspective view showing the test tube holder positioned above a heating block having openings for receiving the tubes stored in the test tube holder.

While the tubes 184 are secured firmly in their tube accommodating holes 114, the test tube holder 100 can be moved and mated with an apparatus such as a heating block as described above. As shown in FIG. 3, the apparatus 186 or heating block (hereinafter "heating block") includes a plurality of openings 188 therein for accommodating the plurality of tubes 184. Specifically, the plurality of openings 188 correspond in number and position to the number and position of tube accommodating holes 114 of test tube holder 100.

As further indicated, the heating block 186 includes openings 190 which are configured to receive the corresponding legs 115 of the test tube holder 100. Hence, the tubes 184 can be inserted directly into the corresponding openings 188 while they are secured in the test tube holder 100.

Figure 4:
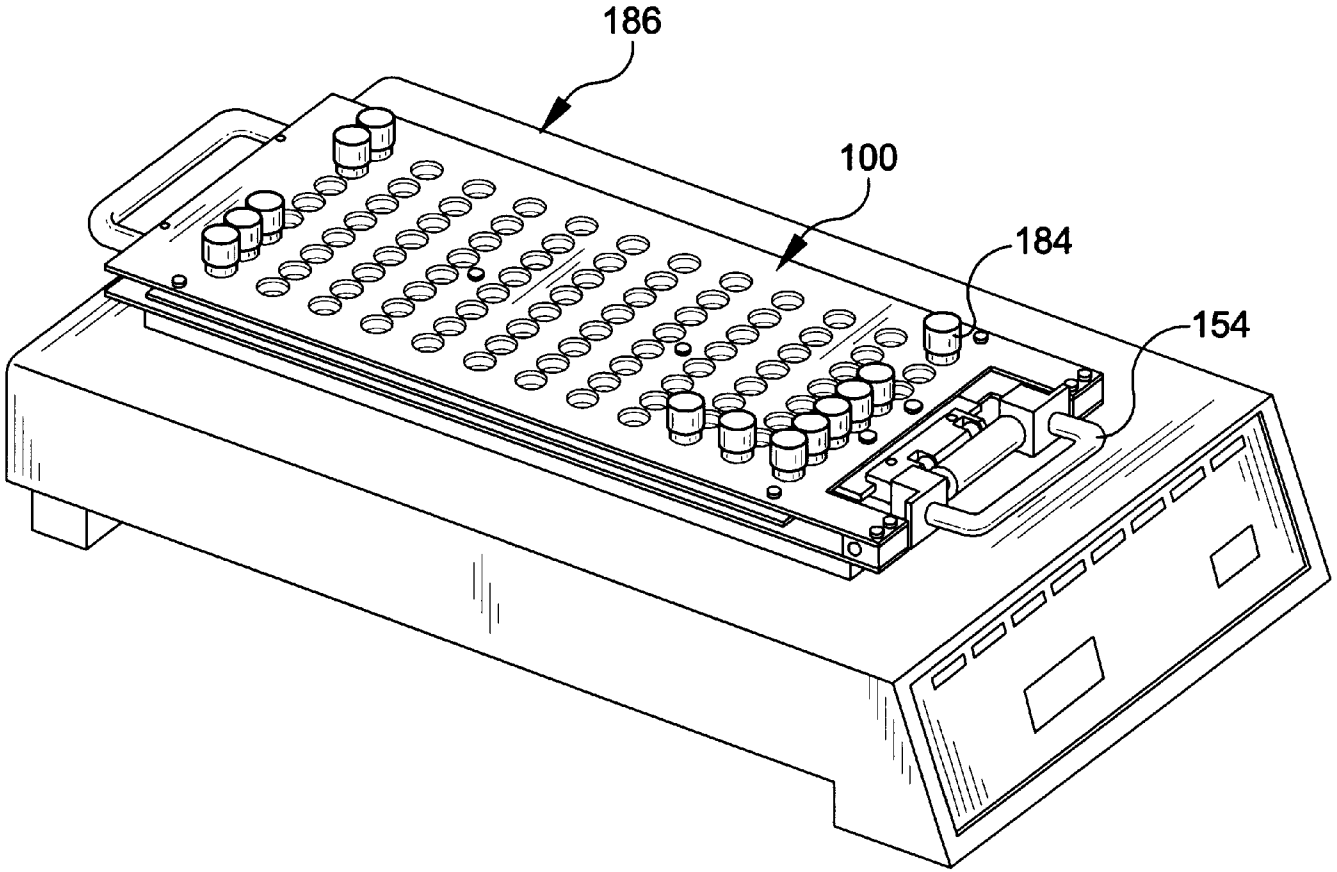
FIG. 4 is a perspective view showing the test tube holder mated with the heating block shown in FIG. 3 so that the test tubes can be inserted into the openings in the test tube holder and into the corresponding openings in the heating block.

Alternatively, as shown specifically in FIG. 4, the test tube holder 100 can be placed directly onto the heating block 186 such that the legs 115 are inserted into their corresponding openings 190 in the heating block 186. In this arrangement, the engagement of the wide diameter portions 115-1 of the legs 115 with the openings 190 prevents or substantially prevents the test tube holder 100 from moving laterally with respect to the heating block 186. Therefore, the openings 190 in the heating block 186 are maintained in alignment or substantial alignment with tube accommodating holes 114 of the test tube holder 100.

Accordingly, when the actuating handle 154 is in an upright position as shown by solid line in FIGS. 1, 2 and 3, the tubes 184 can be inserted into the corresponding tube accommodating holes 114 in the test tube holder 100 and further, pass into the corresponding openings 188 in the heating block 186 virtually without restriction. As shown in FIG. 4 and as will be described in more detail below, when the actuating handle 154 is moved into the horizontal tube-engaging position, the middle plate 106 applies a force against those tubes 184 that are accommodated in tube accommodating holes 114 and thus, maintain the tubes 184 in those holes 114 in a rigid or substantially rigid manner. The test tube holder 100 can then be removed from the heating block 186 without the tubes 184 slipping or shifting in their respective tube accommodating holes 114 in the test tube holder 100.

Figure 5:
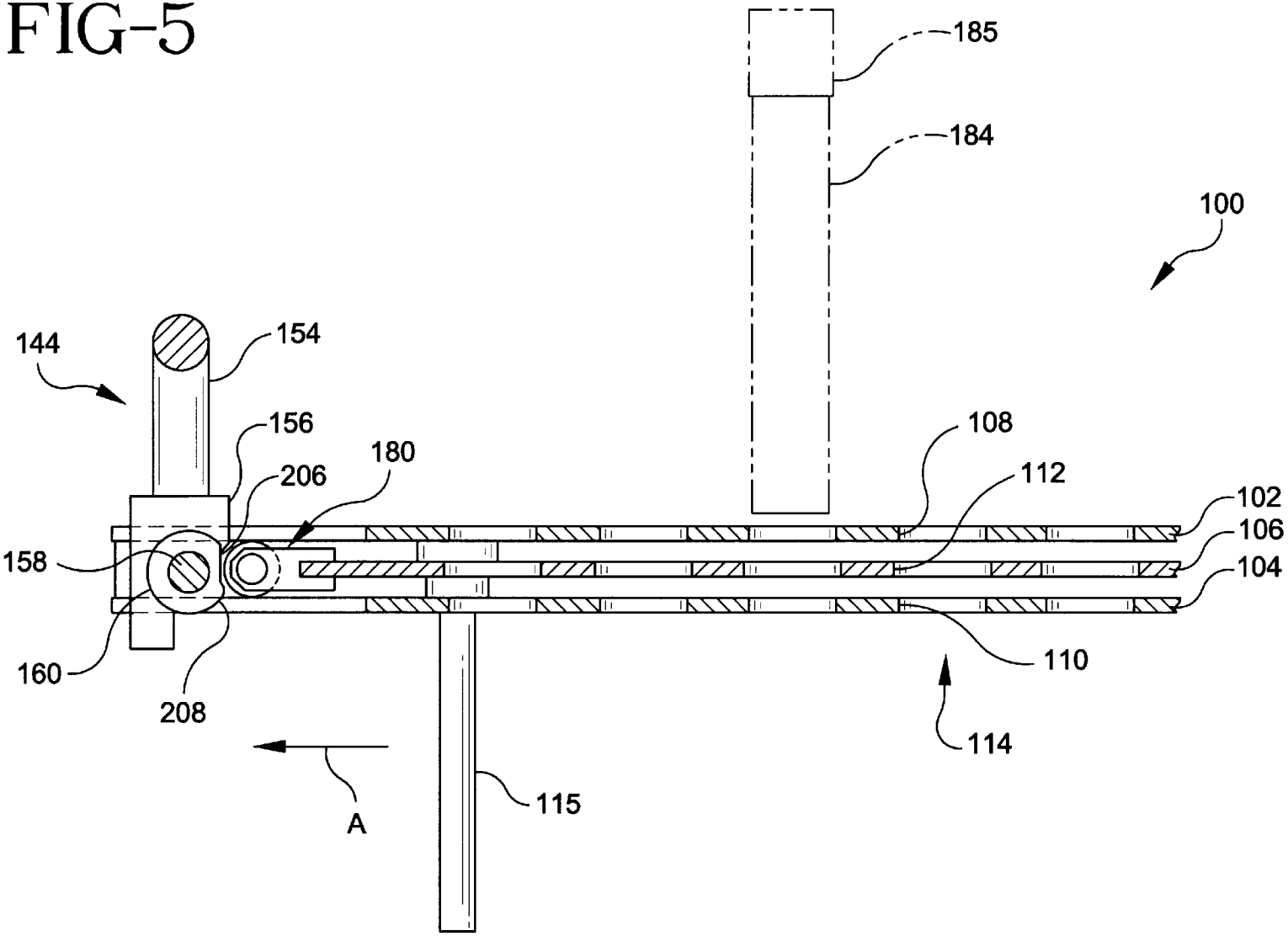
FIG. 5 is a sectional view of the test tube holder as taken along lines 5—5 in FIG. 1 with a tube shown in phantom and the actuating handle shown in a disengaged upright position.
Figure 6:
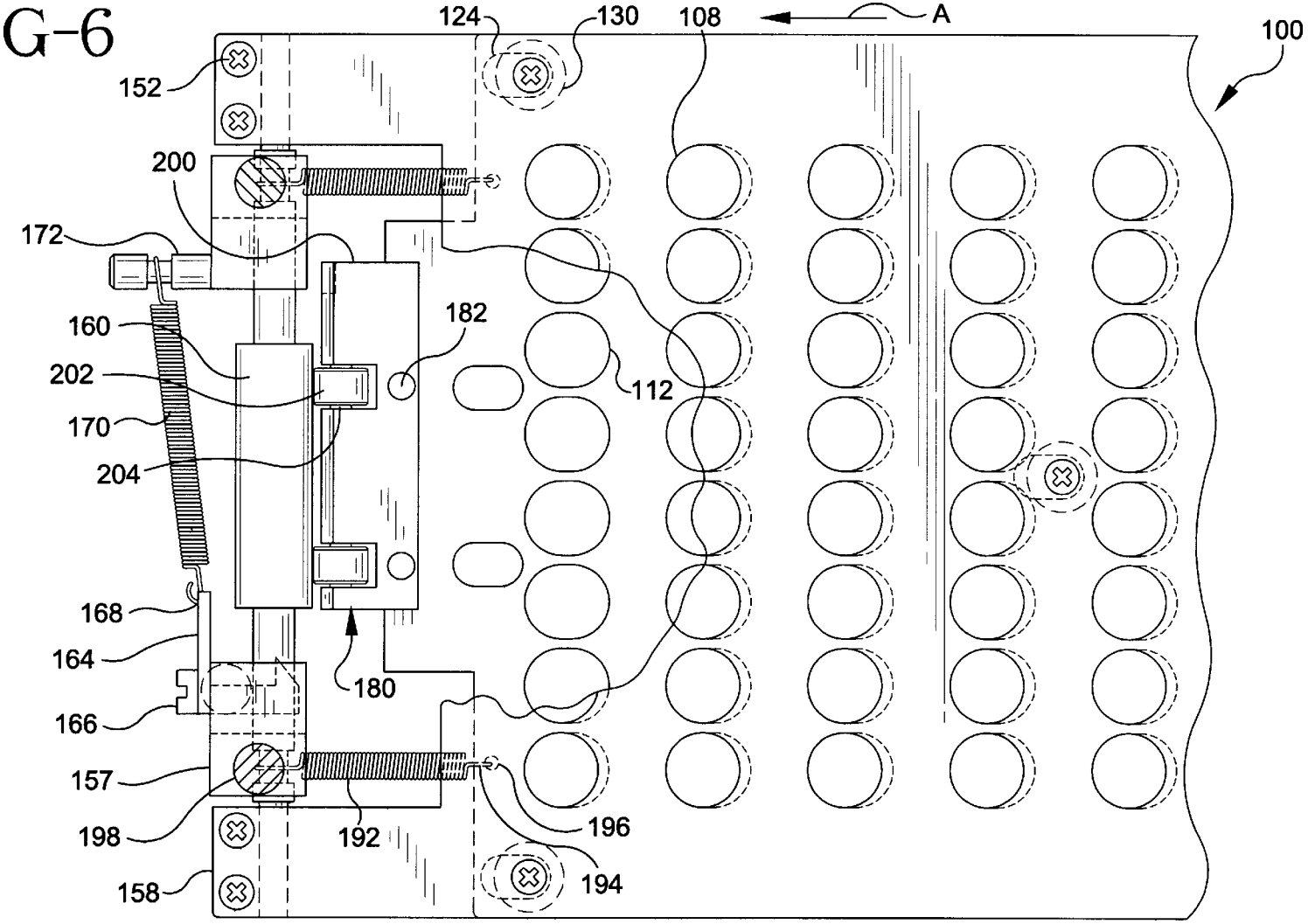
FIG. 6 is a detailed cut away top plan view of the test tube holder illustrating the relationship of the holes in the upper, middle and lower plates when the actuating handle is in the disengaged upright position as shown in FIG. 5.
Figure 7:
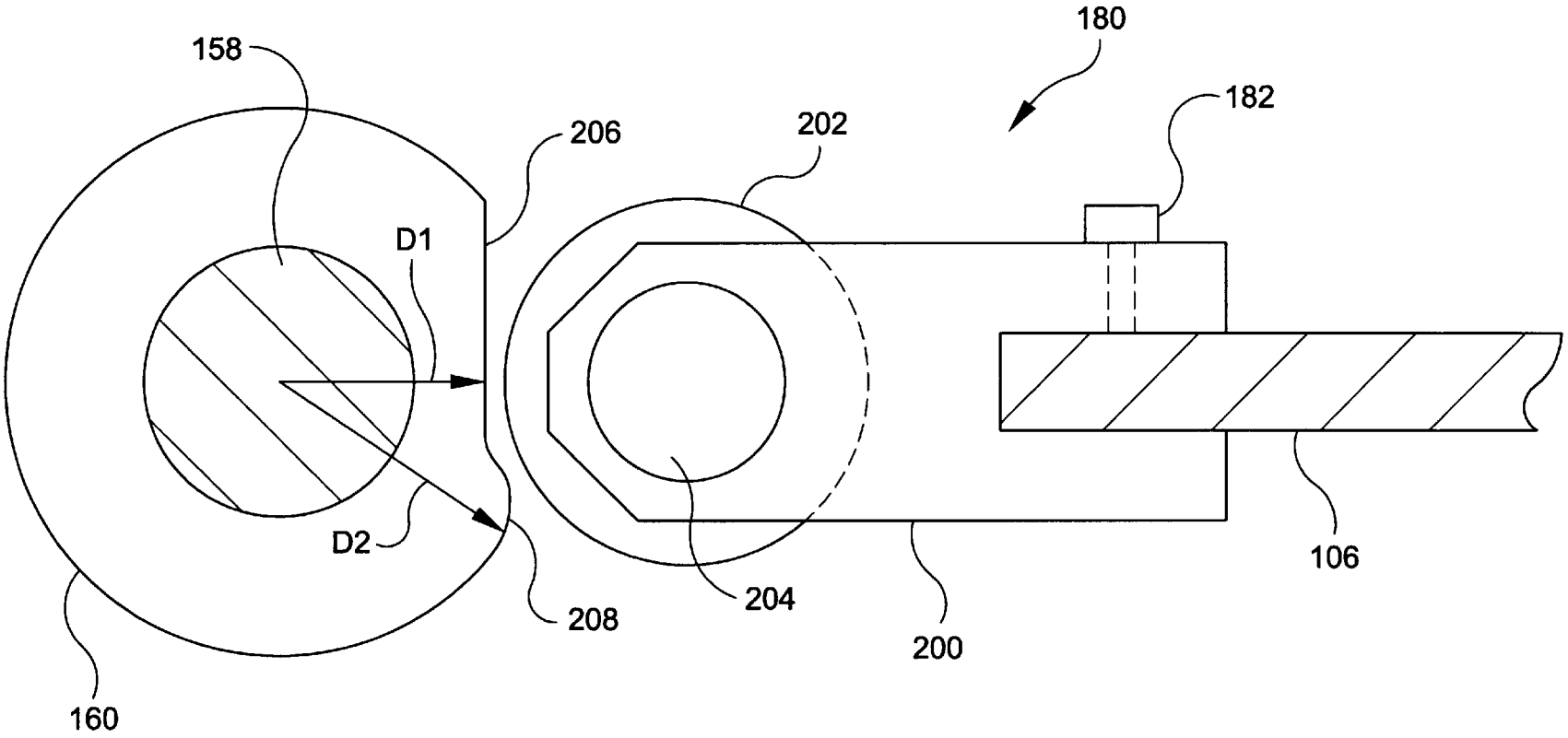
FIG. 7 is a detailed cross-sectional view of the cam of the test tube holder illustrating the orientation of the cam with respect to the rollers of the cam engaging member of the middle plate when the actuating handle is in the disengaged upright position as shown in FIG. 5.

FIG. 5 illustrates a cross-sectional view of the test tube holder 100 as taken along lines 5—5 in FIG. 1. FIG. 6, on the other hand, is a detailed cutaway sectional top plan view of the test tube holder 100 as shown in FIG. 1. As illustrated, when the actuating handle 154 is positioned in the disengaged or upright position, the tube openings 112 of middle plate 106 are positioned in relation to their corresponding tube openings 108 and 110 in upper and lower plates 102 and 104, respectively, such that a tube 184 (shown in phantom) can be inserted into corresponding tube openings 108, 112 and 110 (which make up a tube accommodating hole 114 as described above) without or essentially without interference by the middle plate 106, in particular. As shown in FIG. 6, springs 192 each have one end 194 that engages with an opening 196 in the middle plate 106, and another end 198 that engages with cam shaft 158. Accordingly, the springs 192 urge the middle plate 106 in the direction along arrow A so that the cam engaging portion 180 engages with the cam 160. This engagement is shown in more detail in FIG. 7.

Specifically, the cam engaging member 180 includes a block 200 that is mounted to the middle plate 106 by fastening members 182, and a plurality of rollers 202 that are rotatably mounted to the block 200 by a roller shaft 204. The block 200, rollers 202 and rotating shaft 204 are made of any suitable material, and preferably, are made of aluminum or stainless steel. The cam 160 is also made of stainless steel or aluminum, or any other suitable material having sufficient rigidity. As indicated, when the actuating handle 154 is positioned in the upright disengaged position shown in FIG. 5, the springs 192 urge the middle plate 106 in the direction A toward the cam 160 such that the rollers 202 contact the flat or substantially flat portion 206 of the cam 160. The distance D1 which represents the distance between the outer surface of the cam 160 at the flat portion 206 and the axis of rotation of the cam 160 is less than the distance between the outer surface of the cam 160 at any other portion and the axis of rotation. Hence, the middle plate 106 can move laterally with respect to upper plate 102 and lower plate 104 at a maximum distance along direction A.

When the middle plate 106 is in that position, the walls 113 of the middle plate 106 which form the tube openings 112 are positioned so that they do not obstruct insertion of the tubes 184 into the tube accommodating holes 114. Hence, the bottoms of the tubes 184 can rest on the surface on which the legs 115 of the test tube holder 100 is resting, and the tubes 184 can be removed from the test tube holder 100 essentially without restriction. Also, if the test tube holder 100 is being used with heating block 186 and has been placed onto the heating block 186 as shown in FIG. 4, the tubes 184 can be inserted through the tube accommodating in the test tube holder 100, and enter the openings 188 in the apparatus 186 without interference by the middle plate 106, in particular.

If the test tube holder 100 is then to be moved to another location, it is desirable to secure the tubes 184 in their respective tube accommodating holes 114 in the test tube holder 100 so that they do not move longitudinally or laterally in the openings. Specifically, since certain testing processes may require that the tubes 184 be moved from one heating block 186 to another (not shown), it is desirable to maintain the tubes 184 in the test tube holder 100 in fixed positions corresponding to the positions of the holes 188 of the heating block 186. Hence, because the heating blocks 186 are usually essentially identical, the tubes 184 in the test tube holder 100 will be in general alignment with the openings 188 in any heating block 186 of that type. By maintaining the tubes 184 in a relatively fixed position in the test tube holder 100, the tubes 184 will not shift and thus, when the test tube holder 100 is moved to another heating block 186, the tubes 184 should enter the corresponding openings 188 in that heating block 186 essentially without restriction.

Figure 8:
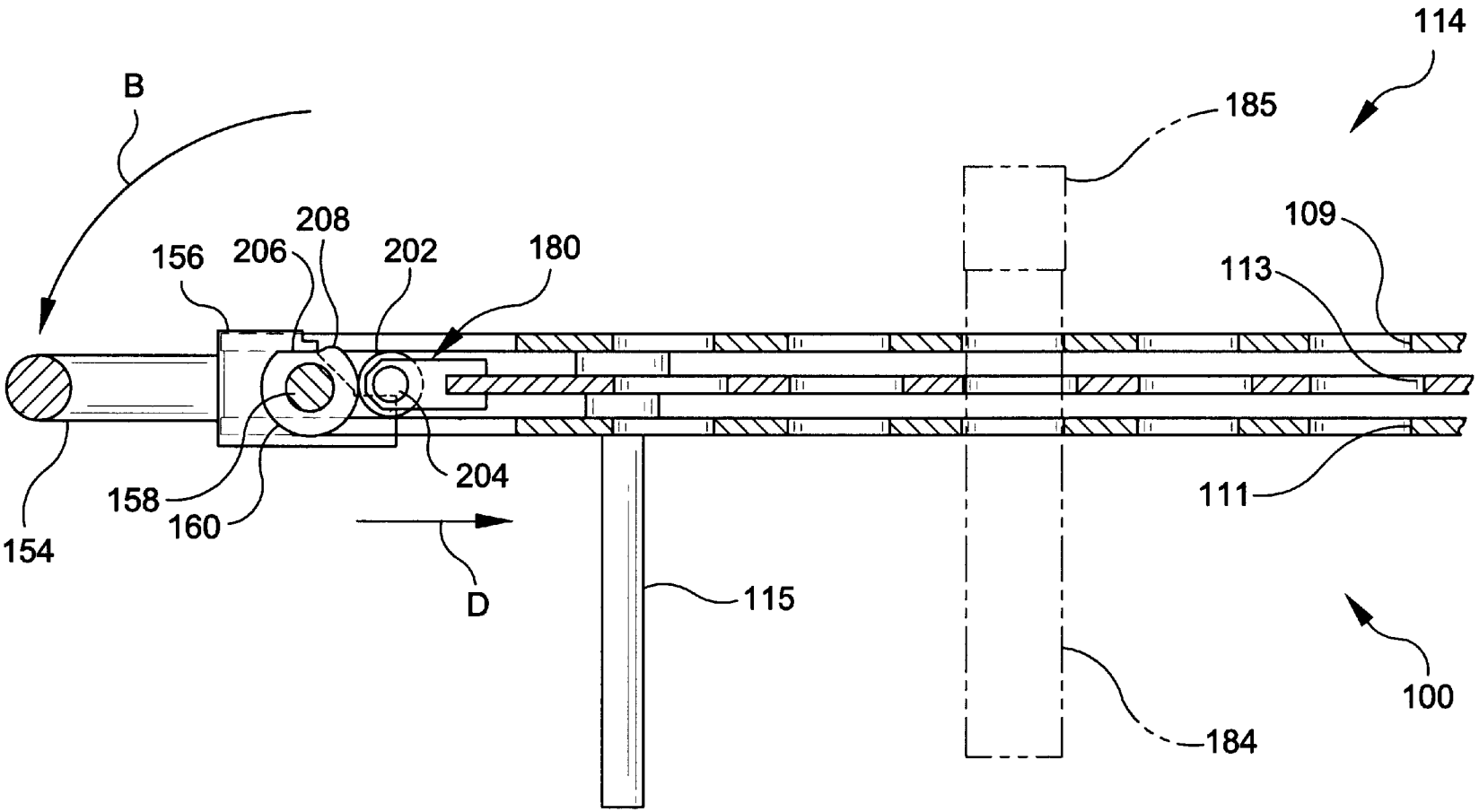
FIG. 8 is a sectional view of the test tube holder with the actuating handle being shown in a horizontal tube-engaging position.
Figure 9:
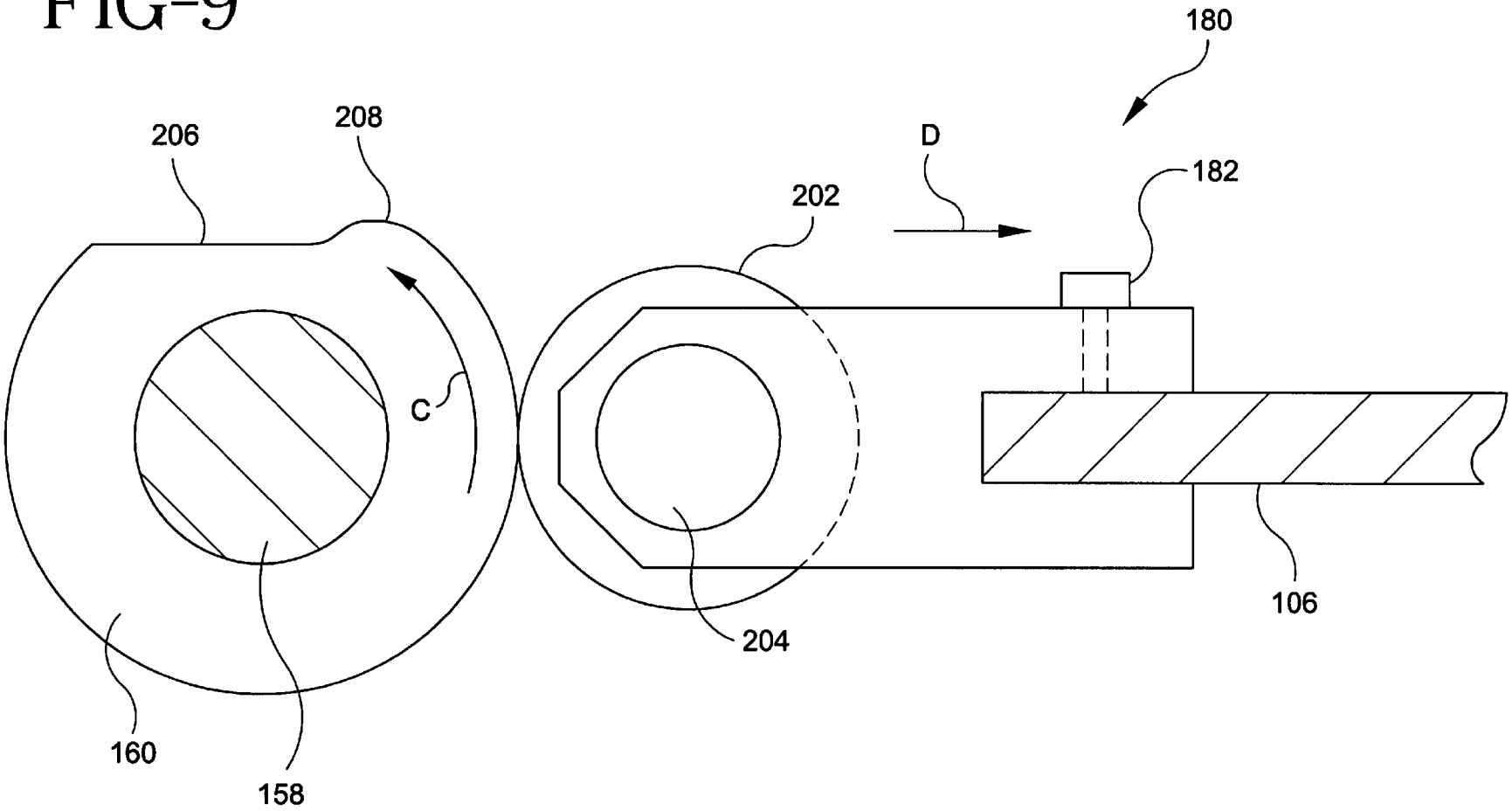
FIG. 9 is a detailed cross-sectional view of the cam of the test tube holder illustrating the orientation of the cam with respect to the rollers of the cam engaging member of the middle plate when the actuating handle is positioned in the horizontal tube-engaging position as shown in FIG. 8.
Figure 10:
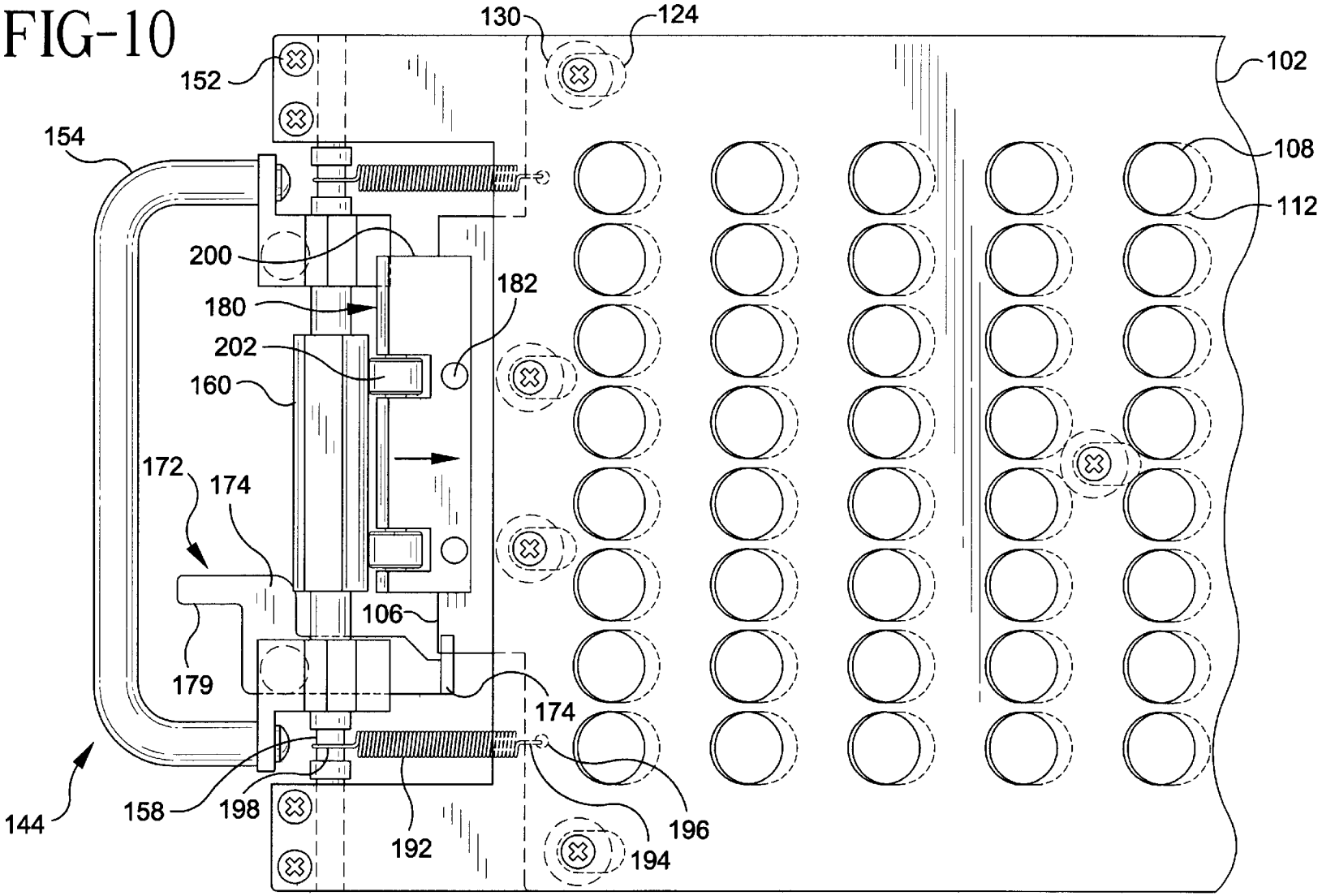
FIG. 10 is a detailed top plan view of the test tube holder, illustrating the relationship of the holes in the upper, middle and lower plates when the actuating handle is in the horizontal tube-engaging position as shown in FIG. 8.

The manner in which the tubes 184 are secured in the test tube holder 100 will now be described. Specifically, as shown in FIGS. 8–10, when the handle 154 of the actuating handle assembly 144 is moved in a direction along arrow B, the cam 160 rotates in a direction indicated by arrow C. It is noted that the distance D2, which represent the distance between the outer surface of the cam 160 at the bulged area 208 and the axis of rotation of the cam 180, is greater than the distance D1 at the flat portion 206, which represents the distance between the outer surface of the cam 160 at the flat portion 206 and the axis of rotation of the cam. Furthermore, the cam 160 is shaped eccentrically. Accordingly, the cam 160 exerts a force in the direction D against the cam engaging member 180 when the cam 160 moves in the direction of arrow C. This force is sufficient to overcome the urging force imposed on middle plate 106 by springs 192. Hence, the middle plate 106 moves in a direction along arrow D as illustrated by a distance equal to the difference in D1 and D2 (i.e., D2–D1). The cam 160 also frictionally engages with rollers 202 to rotate rollers 202 in the direction opposite to that in which the cam 160 is rotating, to thus provide smoother engagement of the cam 160 with the cam engaging member 180.

It is further noted that since the cam 160 is eccentric, cam 160 initially moves the middle plate 106 by a large amount (i.e., the difference between D1 and D2) in the direction D when the bulged portion 204 first engages the rollers 202, and then gradually moves the middle plate 106 further in the direction D as the cam 160 continues to rotate in the direction C. It is noted that this cam 160 and actuating handle 154 arrangement provides a significant mechanical advantage to move the middle plate 106 and thus squeeze the tubes 104.

As shown specifically in FIGS. 8 and 10, because the plate 106 moves in the direction along arrow D, the pattern of holes 112 shifts accordingly. In particular, the walls 113 of the middle plate 106 that form the tube openings 112 in the middle plate 106 become shifted from their original position. This shifting of the walls 113 causes the portions of the walls 113 on the sides of the openings 112 closest to the cam 160 to contact the tubes 184 that are situated in tube accommodating holes 114.

Accordingly, as the cam 160 rotates in direction C and the bulged portion 208 engages the rollers 202, the walls 113 of the middle plate 106 exert a force against tubes 184, and force tubes 184 against the walls 109 and 111 of the plates 102 and 104, respectively, which form holes 108 and 110. As the cam 160 continues to rotate in the direction along arrow C, the walls 113 squeeze the tubes against walls 109 and 111. Due to this force exerted by the walls 113 of metal plate 106 against the tubes 184, as well as the force exerted onto walls 109 and 111 by tubes 184, an increased frictional force is created between the walls of the tubes 184 and the walls 109, 111 and 113. It is further noted that the tube 184 is made out of a resilient plastic material having a rigidity sufficient enough to exert force back against walls 113, 109 and 111, which thus increases the frictional force between the wall of the tube 184 and walls 109, 111 and 113 of the plates 102, 104 and 106, respectively. An example of a tube suitable for use with the tube holder 100 is a plastic or polypropylene tube made by Evergreen company.

Accordingly, this increased frictional force prevents the tube 184 from moving laterally or longitudinally in the tube openings 108, 110 and 112 and thus, the tube 184 essentially maintains its position in its respective tube accommodating hole 114 at the time that the actuating handle 154 was moved to the tube-engaging position. Also, the force is sufficient to enable the cap 185 of tube 184 to be screwed off without the tube 184 rotating in its respective tube accommodating hole 114. This allows for one-handed removal of cap 185 from test tubes 184 by, e.g., a lab technician, which speeds up laboratory procedures, and leaves the technician with a free hand to, for example, operate other equipment, and so on.

Figure 11:
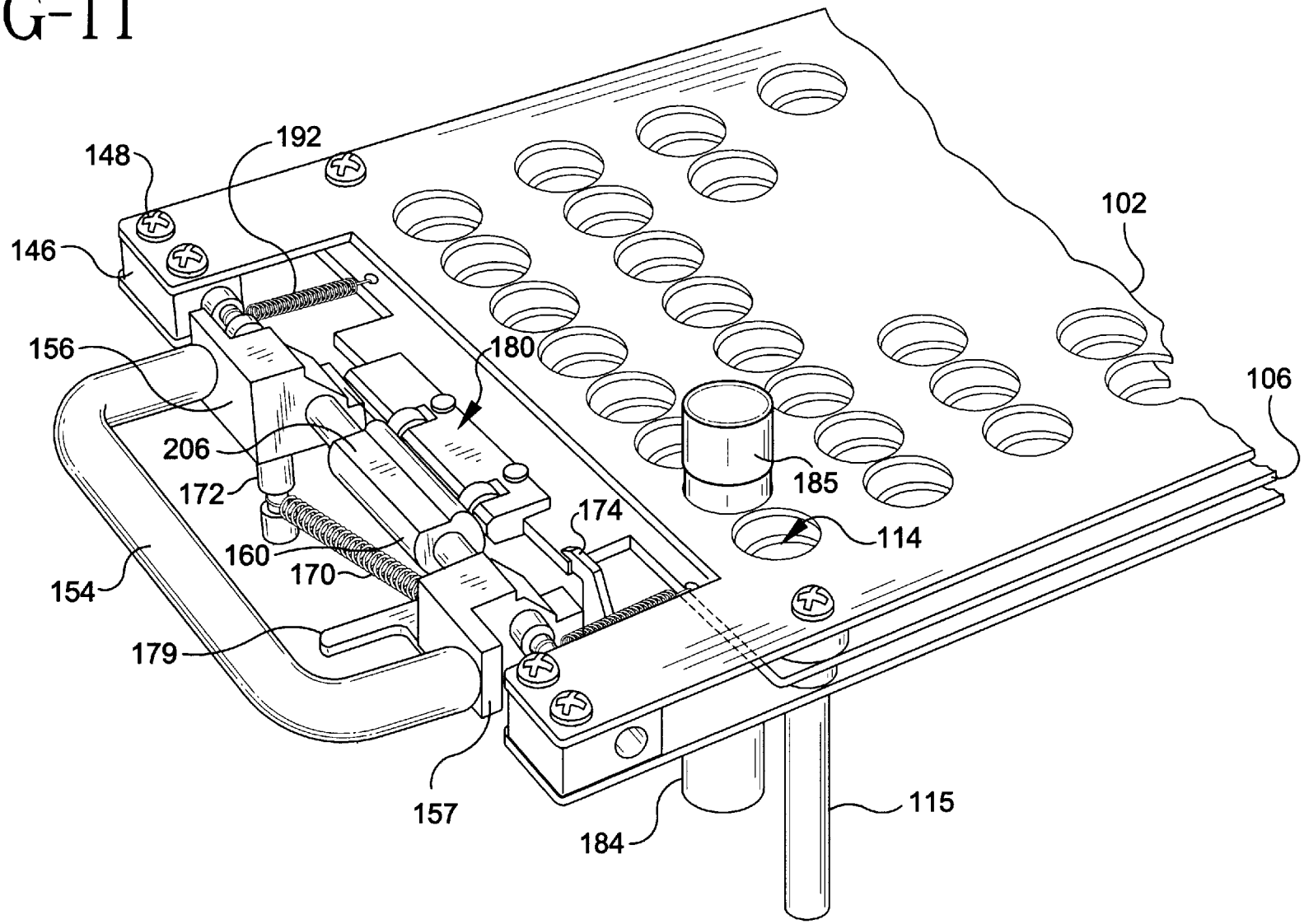
FIG. 11 is a detailed perspective view illustrating the operation of the latching mechanism when the actuating handle is positioned in the horizontal tube-engaging position as shown in FIG. 8.

As shown in FIG. 11, once the actuating handle 154 has been moved to the horizontal tube-engaging position, the locking member 162 engages the metal plate 106 to maintain the actuating handle 154 in the horizontal tube-engaging position until the locking member 162 is released. That is, as discussed above with respect to FIGS. 1 and 2 specifically, the locking member 162 includes a latch 164 that is pivotally coupled to the handle block 157. As the actuating handle 154 is moved to the horizontal tube-engaging position, the blocks 156 and 157 rotate in unison with the movement of the handle 154, cam shaft 158, and cam 160. The latch 164 also moves in unison with the block 157 to which it is pivotally coupled. As the handle 154 approaches the horizontal engaged position, the slanted surface 176 of the latch 164 will contact the bottom surface of the middle plate 106. This slanted surface 176 will act as a wedge and exert a force against the latch 164 opposing the force exerted on the latch 164 by the torsion spring in block 157 (or alternatively spring 170). Accordingly, this force will cause the latch 164 to pivot about the fastening member 166.

The projection 174 of the latch 164 will thus move so that it passes around the middle member 106. However, once the projection 174 passes so that the slanted surface 176 no longer contacts the bottom surface of the middle member 106, the torsion spring (or spring 170) will urge the latch 164 to pivot in the opposite direction, and thus cause the latch 164 to abut against the middle plate 106 as shown specifically in FIG. 11. The flat surface 178 of the projection 174 of the latch 164 contacts the upper surface of the middle plate 106 and thus prevents the actuating handle 154 from being moved back to the upright disengaged position.

Once it is desirable to move the actuating handle 154 back to the upright disengaged position, an operator can apply a force against the release handle 179 of the latch 164, which will cause the latch 164 to pivot about the fastening member 166 so that the flat surface 178 of the projection 174 no longer contacts the upper surface of the middle member 106. The latch 164 will thus have released from the middle member 106, and the actuating handle 154 can be moved back to the upright disengaged position. When this occurs, the cam 160 will rotate about the cam shaft 158 in unison with the movement of the handle 154 so that the flat portion 206 of the cam 160 again contacts the rollers 202. When this occurs, the force exerted on the middle plate 106 by the springs 192 will cause the middle plate 106 to move in the direction A as shown in FIG. 5, and thus remove the force exerted by walls 113 on the tubes 184. Accordingly, the tubes 184 will then be allowed to move in an essentially unrestricted manner in openings tube 108, 110 and 112. The tubes 184 can then be physically taken out of the test tube holder 100 one at a time or all at once. Also, the test tube holder 100 can be turned upside down, and the latch 164 released and the actuating handle 154 moved to the disengaged position, so that the tubes 184 are allowed to fall out of their respective tube accommodating holes 114.

Figure 12:
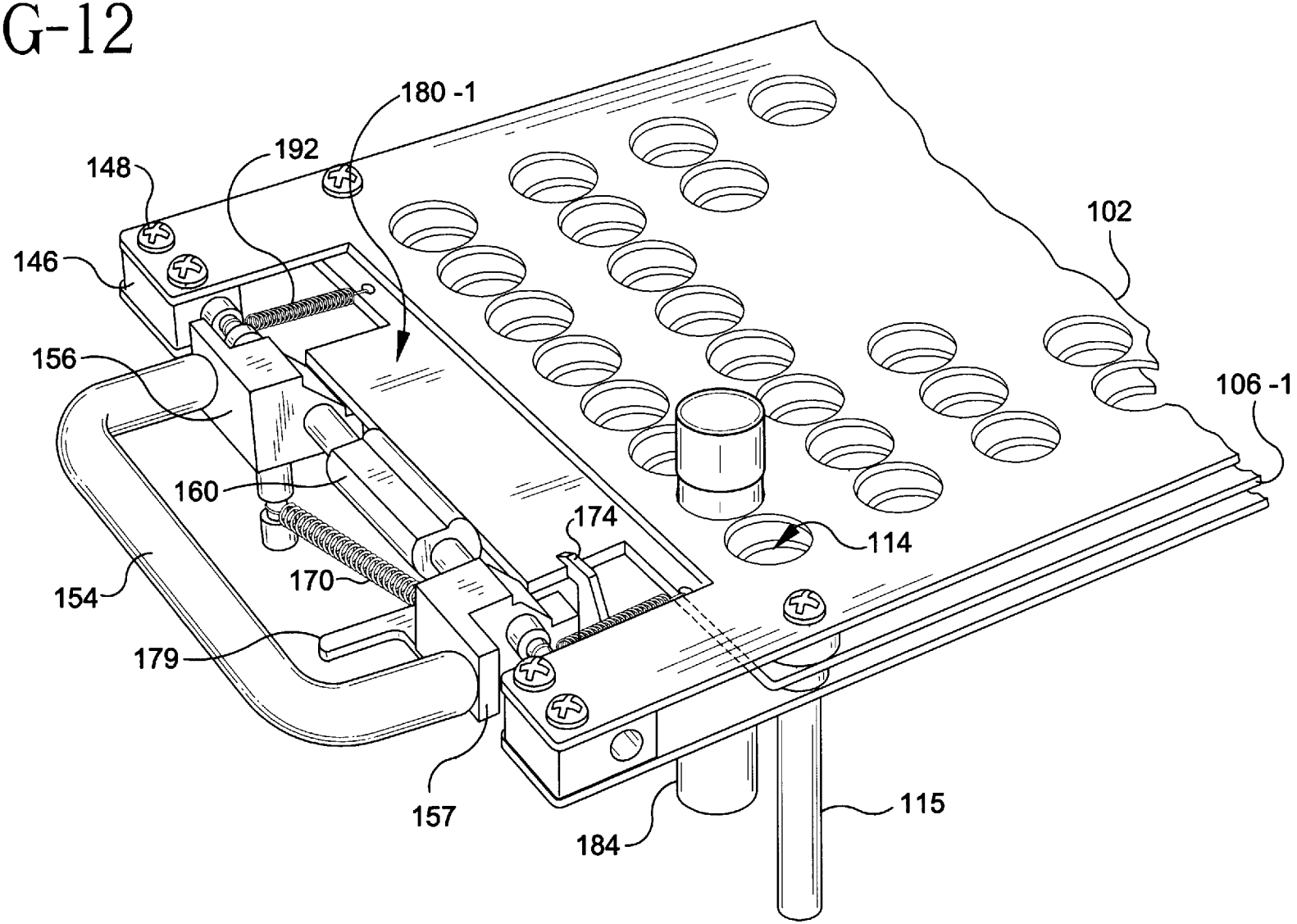
FIG. 12 is a detailed perspective view showing a variation of the cam engaging member of the middle plate according to another embodiment of the present invention.

An alternate embodiment of the cam engaging member 180 is shown in FIG. 12. In this embodiment, the middle plate 106-1 is similar to plate 106 discussed above in all respects, except that middle plate 106-1 has an extended portion 180-1 which engages with the cam 160 in a manner similar to that in which the cam engaging portion 180 engages with the cam 160. However, because no rollers are present on this extended portion 180-1, the cam 160 engages directly with the middle plate 106-1 to facilitate the movement similar to that described above with regard to middle plate 106 when the actuating handle 154 is moved between the upright disengaged position and horizontal tube-engaging position. Although this embodiment does perform the intended function of securing the tubes 184 in the tube accommodating holes 114, it is somewhat less preferred than the embodiment discussed above that employs the rollers 202 which provide a smoother engagement with the cam 180.

The embodiments described above can further be modified for use, in particular, with glass or essentially unflexible tubes or containers. Specifically, the holes 112 in plate 106 (or 106-1 in the alternate embodiment) can be lined with a resilient material (such as rubber, foam rubber, or the like) which provides reliant properties similar to those that are provided by the plastic tubes as discussed above. Accordingly, instead of the unflexible tubes (e.g., glass tubes) flexing, the resilient member flexes when pressed against the unflexible tubes when the middle plate 106 (or 106-1) is moved in a direction along arrow D (FIG. 8), and thus exerts a force against the tubes sufficient to hold the tubes securely in the holes 114 without fracturing them. Also, if desired, the holes 108 and 110 in upper 102 and lower 104 plates can be lined with the resilient material to provide additional protection against tube breakage.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An apparatus for holding a plurality of containers, comprising:

a first member, having a first surface and a plurality of first walls defining a plurality of first openings which extend through the first member transversely of the first surface;

a second member, mechanically coupled to the first member and having a second surface facing in a direction toward the first surface of the first member, and a plurality of second walls defining a plurality of second openings which extend through the second member transversely of the second surface, the first and second openings being substantially aligned with each other to form a plurality of first and second opening pairs, each of the first and second opening pairs being configured to receive one of the plurality of containers;

a third member, configured to move along a moving direction, which is substantially lateral of the first and second surfaces, between a container engaging position and a container disengaging position; and a driving member, configured to locate the third member in the container engaging position, such that when the containers are received in the first and second opening pairs, the third member is configured to apply an engaging force against the containers to urge the containers toward the first and second walls of their corresponding first and second opening pairs to substantially maintain the containers at corresponding fixed positions in their corresponding first and second opening pairs, said driving member further being configured to locate the third member in the container disengaging position, such that when the containers are received in the first and second opening pairs, the third member is configured to release the engaging force from the containers.

2. An apparatus as claimed in claim 1, wherein the third member comprises a third surface, facing in a direction toward one of the first and second surfaces, and a plurality of third walls defining a plurality of third openings which extend through the third member transversely of the third surface, the plurality of third openings being substantially aligned with the plurality of first and second opening pairs when the third member is positioned in the container disengaging position; and the plurality of third walls apply the engaging force against the containers received in the first and second opening pairs when the third member is positioned in the container engaging position.

3. An apparatus as claimed in claim 1, wherein the third member is disposed at a location between the first and second surfaces of the first and second members, respectively.

4. An apparatus as claimed in claim 1, wherein the driving member comprises:

an engaging member, configured to be movable between a driving position in which the engaging member positions the third member in the engaging position, and a releasing position in which the engaging member enables the third member to be returned to the disengaging position; and a handle member, mechanically coupled to the engaging member, and being movable between a handle engaged position which positions the engaging member in the driving position, and a handle released position which positions the engaging member in the releasing position.

5. An apparatus as claimed in claim 4, wherein the engaging member is a cam, configured to rotate between the driving and releasing positions about a cam rotating axis transverse to a direction of movement of the third member between the container engaging and container disengaging positions, the cam having a surface which engages a portion of the third member to move the third member from the container disengaging position toward the container engaging position when the cam rotates from the releasing position toward the driving position.

6. An apparatus as claimed in claim 5, wherein a first portion of the cam has a first radius, and a second portion of the cam has a second radius larger than the first radius; and the surface of the cam which engages the portion of the third member extends about at least some of the first portion and about at least some of the second portion, such that the surface of the cam extending about the at least some of the first portion engages the portion of the third member before the surface of the cam extending about the at least some of the second portion when the cam rotates from the releasing position to the driving position.

7. An apparatus as claimed in claim 5, wherein the portion of the third member comprises at least one roller, rotatable about a roller axis extending in a direction substantially parallel with the cam rotating axis;

the surface of the cam engaging the at least one roller to drive the at least one roller to rotate about the roller axis when the cam rotates between the releasing and driving positions.

8. An apparatus as claimed in claim 4, further comprising:

at least one handle, configured to have a force applied thereto to move the apparatus; and wherein the at least one handle comprises the handle member.

9. An apparatus as claimed in claim 1, further comprising:

an urging device, configured to apply an urging force to the third member which urges the third member toward the container disengaging position; and wherein the driving member applies a driving force opposing the urging force sufficient to overcome the urging force when the driving member moves the third member from the container releasing position to the container engaging position.

10. An apparatus as claimed in claim 1, further comprising:

a locking device, configured to releasably lock the driving member such that the driving member maintains the third member in the container engaging position.

* * * * *